US007090627B1

(12) United States Patent
Walker

(10) Patent No.: US 7,090,627 B1
(45) Date of Patent: Aug. 15, 2006

(54) DEVICE FOR EXERCISING ABDOMINAL MUSCLES

(76) Inventor: Andre Laddarrel Walker, 1427 S. Dayton. St., Aurora, CO (US) 80010-3232

( * ) Notice: Subject to any disclaimer, the term of this patent is extended or adjusted under 35 U.S.C. 154(b) by 250 days.

(21) Appl. No.: 10/255,224

(22) Filed: Sep. 26, 2002

(51) Int. Cl.
*A63B 26/00* (2006.01)
*A63B 71/00* (2006.01)

(52) U.S. Cl. ..... 482/140; 482/126; 482/38; 482/121

(58) Field of Classification Search ..... 482/140, 482/907, 91, 126, 121–22, 129–130, 38; 2/200, 267; 5/500; 128/845, 870; 36/71; D21/665, 679; 480/140, 907, 121–130
See application file for complete search history.

(56) References Cited

U.S. PATENT DOCUMENTS

| | | | | |
|---|---|---|---|---|
| 3,117,781 | A * | 1/1964 | Vargo | 482/91 |
| 3,820,781 | A * | 6/1974 | Kane | 482/93 |
| 4,770,414 | A * | 9/1988 | Fredrickson et al. | 482/148 |
| 5,125,649 | A * | 6/1992 | Fuller | 482/123 |
| 5,653,665 | A * | 8/1997 | Neeley | 482/106 |
| 6,120,424 | A * | 9/2000 | Arline | 482/121 |
| 6,126,581 | A * | 10/2000 | Hartsel | 482/140 |
| 2004/0029689 | A1 * | 2/2004 | Contreras | |

* cited by examiner

*Primary Examiner*—Lori Amerson

(57) ABSTRACT

An article for allowing a person to exercise the oblique abdominal muscles comprises a rigid member, in accordance with a preferred method of use, is grasped in the hands and held behind the neck. At either end of the rod, an elastic member extends downward with the distal end of each elastic member being held against the floor by the person's foot. As the user swivels the upper body, the elastic members are placed in tension and provide resistance for exercising the oblique abdominal muscles.

14 Claims, 6 Drawing Sheets

DEVICE FOR EXERCISING ABDOMINAL MUSCLES

FIELD OF THE INVENTION

The present invention relates to the field of exercise equipment and, in particular, to an article and method for exercising oblique muscles of the abdomen.

BACKGROUND OF THE INVENTION

Various techniques are known for exercising and toning the many skeletal muscles of the human body. People who exercise often target the abdominal muscles for a variety of practical or aesthetic reasons. Exercises such as sit-ups are effective at toning the rectus abdominis muscles of the abdomen. When contracted, these muscles can make the front of the abdomen rigid or cause flexion of the torso. A device for exercising these muscles is taught in U.S. Pat. No. 6,440,045 to Gaston.

While many exercises and implements have been created to develop the rectus abdominis muscles, relatively little attention has been given to exercising the internal and external oblique muscles which wrap the sides of the abdomen above each hip. For some individuals wanting to achieve a desired body shape, this part of the body can be especially difficult to tone. The oblique muscles serve to swivel the upper body with respect to the hips.

One device that is commonly found in gyms provides for a user to sit upright and couple their arms to a yoke that swivels in a vertical axis roughly aligned with the user's spine. The yoke is in turn coupled to an adjustable weight stack or the like so that the user can vary the force required to turn the yoke. This device is large and cumbersome. Furthermore, the use of weights for resistance to motion also introduces inertia, increasing the chance that misuse of the device may result in injury to muscles and other tissues. The inertial effects increase as greater weights are used for resistance. The effectiveness of this device varies from person to person. Some people may properly use the oblique muscles to rotate the yoke whereas other people may rely upon other muscles to coax the yoke around.

U.S. Pat. No. 6,126,581 to Hartsel teaches a piece of exercise equipment designed to be placed behind a person's head and to hold the person's arms in a position substantially above and behind the chest as exercises are performed. Exercise activities performed while lying on one's back, such as sit-ups or "bicycling", and using the Hartsel invention are intended to strengthen abdominal muscles, including oblique abdominal muscles. To increase resistance, weights may be added to the Hartsel device. In accordance with Hartsel, increasing resistance involves increasing overall mass of the device and increasing the rotational inertia.

SUMMARY OF THE INVENTION

A means is needed for more specifically exercising oblique abdominal muscles. It is also preferable that such means be compact and transportable as well as easy to set up and use.

Accordingly, the present invention is directed to an apparatus for use by a person to exercise the oblique abdominal muscles. In accordance with a preferred exemplary embodiment, a rod is provided with elastic straps at either end. In accordance with a preferred method of use, the user grasps the rod near either end and places the rod behind the base of the neck and parallel to the shoulders, resting on the neck.

The rod is preferably of sufficient length such that, when placed across the user's shoulders in this manner, the rod protrudes beyond the user's shoulders on either side allowing the user to comfortably grasp the rod with both hands. While being held in this manner, the rod is effectively mechanically coupled to the upper body or the thoracic portion of the user's body. With the rod being held so by the user, the elastic straps dangle freely downward towards the floor.

In accordance with a preferred embodiment, each elastic strap has attached, at the end distal to the rod, an anchoring element that the user may secure under foot.

To secure the free ends of the straps, the user then crouches to bring the anchoring elements close enough to the floor to allow each anchoring element to be captured under a foot of the user. The user then returns to a standing position with the bottom end of each strap now secured by the user standing upon the anchoring elements.

After assuming a desired stance, the user then exercises the oblique muscles by rotating the upper body relative to the position of the feet while holding the rod approximately parallel to the shoulders. The elastic straps offer resistance to this motion, thereby causing the oblique muscles to be selectively exercised.

In accordance with a preferred embodiment, the elastic straps are provided with means for the user to adjust the length, the spring constant (stiffness), or both to accommodate users of various stature and to allow a user to adjust the pre-tension and resistance offered by the elastic straps.

More generally, then, the present invention may be characterized as a device to aid a user in exercising abdominal muscle comprising: a rigid member for being mechanically coupled to the upper body of the user whereby rotational movement of the upper body imparts rotational movement to the elongated rigid member; and at least one extensible resistance member having a first end and second end, wherein the first end is attached to the rigid member and the second end is attachable to a location isolated from the movement of the user's upper body, whereby rotational movement of the rigid member causes change in extension of the extensible resistance member and the extensible resistance member exerts a force on the rigid member opposing the change in extension.

The present invention also involves a method for exercising abdominal muscle of a person comprising the steps of: coupling a rigid member to the upper body of the person whereby rotation of the upper body of the person relative to the lower body of the person causes rotation of the rigid member relative to the lower body of the person; coupling a first end of at least one extensible resistance member to the rigid member; coupling a second end of the extensible resistance member to a location that remains substantially fixed relative to the lower body of the person whereby rotational movement of the elongated rigid member causes change in extension of the extensible resistance member and the extensible resistance member exerts a force on the rigid member opposing the change in extension; and using the abdominal muscle of the person to force the rigid member to rotate relative to the lower body of the person and to cause the extensible resistance member to change in extension.

An exercise device in accordance with the present invention is advantageous for allowing for increasing resistance, and therefore intensity of exercise, without a substantial or proportional increase in mass or rotational inertia. Furthermore, an exercise device in accordance with the present invention is advantageous for being compact and lightweight and for allowing the user to exercise in an upright standing position or while seated, such as in a wheelchair.

BRIEF DESCRIPTION OF THE DRAWINGS

The present invention, as well as further features and advantages thereof, will be understand by way of the following detailed description of an exemplary embodiment in conjunction with the accompanying drawings wherein.

DETAILED DESCRIPTION

As those of ordinary skill in the relevant art will recognize, the present invention may be employed and embodied in a variety of ways. The following detailed description is provided for clearly teaching an exemplary embodiment but should not be construed to limit the invention in any way.

Figure 1:
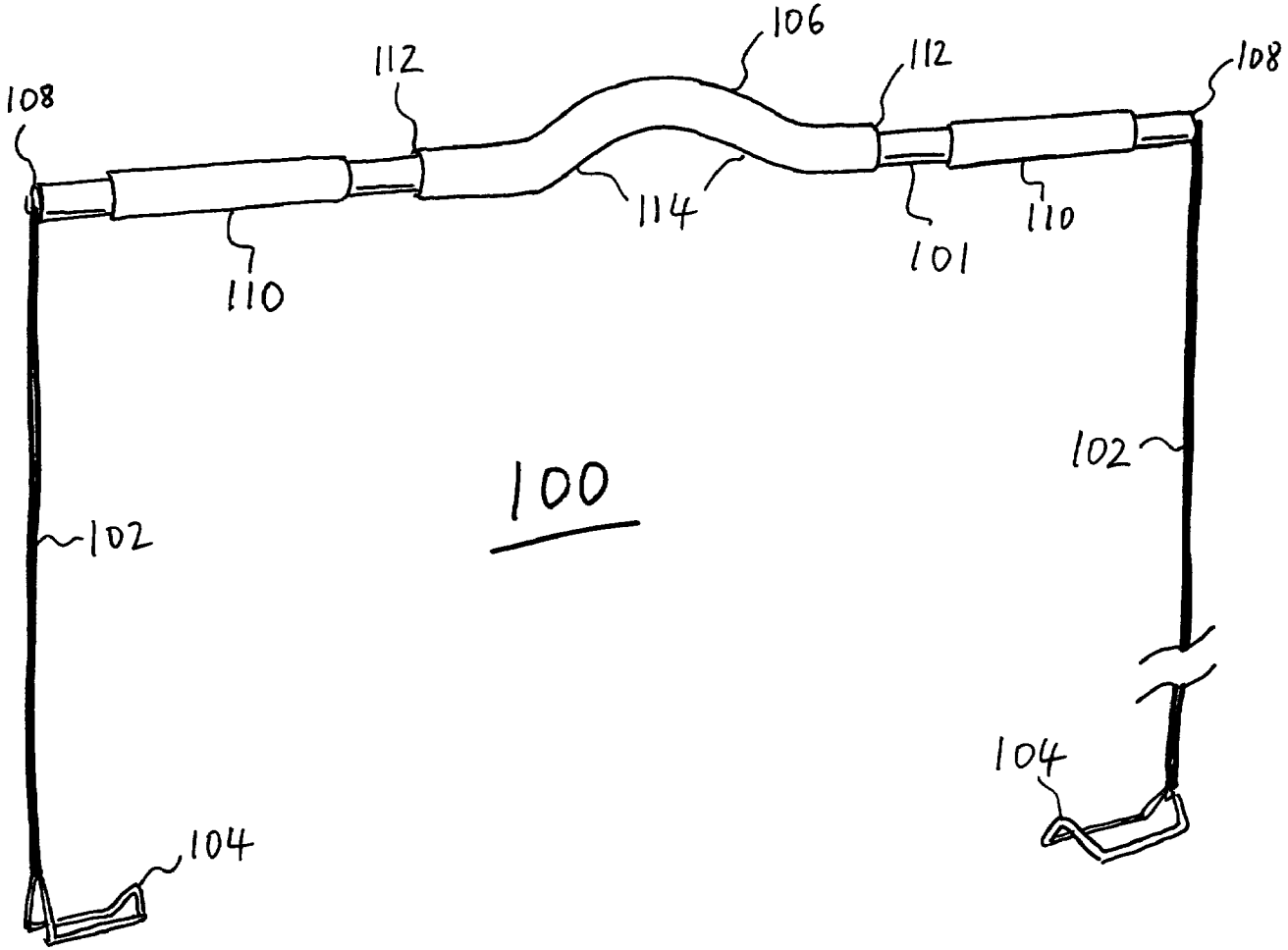
FIG. 1 is a pictorial of an exercise device in accordance with an exemplary embodiment of the present invention.

FIG. 1 of the drawings shows an exercise device 100 in accordance with an exemplary embodiment of the present invention. For clearer understanding, FIG. 2 and FIG. 3 may be consulted as well during the following description.

As shown in FIG. 1, rigid rod 101 comprises grip areas 110 near either end and a middle section 106 which, in use, roughly aligns with and perhaps engages the back of the user's neck. Arcuate section 114 of middle section 106 may be curved as shown and may be further shaped and contoured, even in cross-section, to promote comfortable contact with user's neck and shoulders. Resilient coatings or padding may be applied to middle section 106 to further enhance user comfort.

Middle section 106 may also be formed with such curvature as to displace other sections of rod 101 sufficiently forward to make it easier for the user to hold rod 101 behind the neck, that is, without requiring that the user's hands reach well behind the shoulders. The proper forming of middle section 106 may also help exercise device 100 stay in place on the user's shoulders as forces are applied during exercise motions.

Those of ordinary skill in the relevant art will recognize that rod 101 may take many forms and may be formed of a variety of materials. Rod 101 may be more generally characterized as an elongated rigid member and may be formed of, for example, tubular metal, plastic, wood, or a composite material such as graphite-filled resin or fiberglass.

Grip areas 110 may be plain portions of rod 101 or may be places where rod 101 is overcoated with a textured material or a resilient material, such as plastic or foam rubber, to improve grip and promote comfort. Grip area 110 may also be treated by knurling or texturing of the surface of rod 101 to improve grip.

Along rod 101, detachment points 112 are shown in FIG. 1 to indicate where rod 101 might be disassembled into separate sections, as is described further below in conjunction with FIGS. 6A and 6B.

On either end of rod 101, an attachment point 108 is provided whereby an elastic member 102 is coupled to rod 101. Depending upon the form of elastic member 102, attachment point 108 may comprise various clamps, swivels, clasps, screws, buckles, fasteners, or a combination thereof to accomplish positive attachment that will be maintained as rod 101 applies forces to each elastic member 102 during use by the user. A loop or "eye" may be provided as attachment point 108 to allow one or more elastic members 102 to be removably attached thereto by the use of curved hooks or other means. Those of ordinary skill may readily obtain and implement various suitable means of attachment at attachment points 108 without requiring further explicit description herein. During use of exercise device 100 as taught herein, each elastic member 102 provides resistance to motion of rod 101 as the rotation of the upper body relative to the lower body of the user places tension upon the elastic members.

Figure 2:
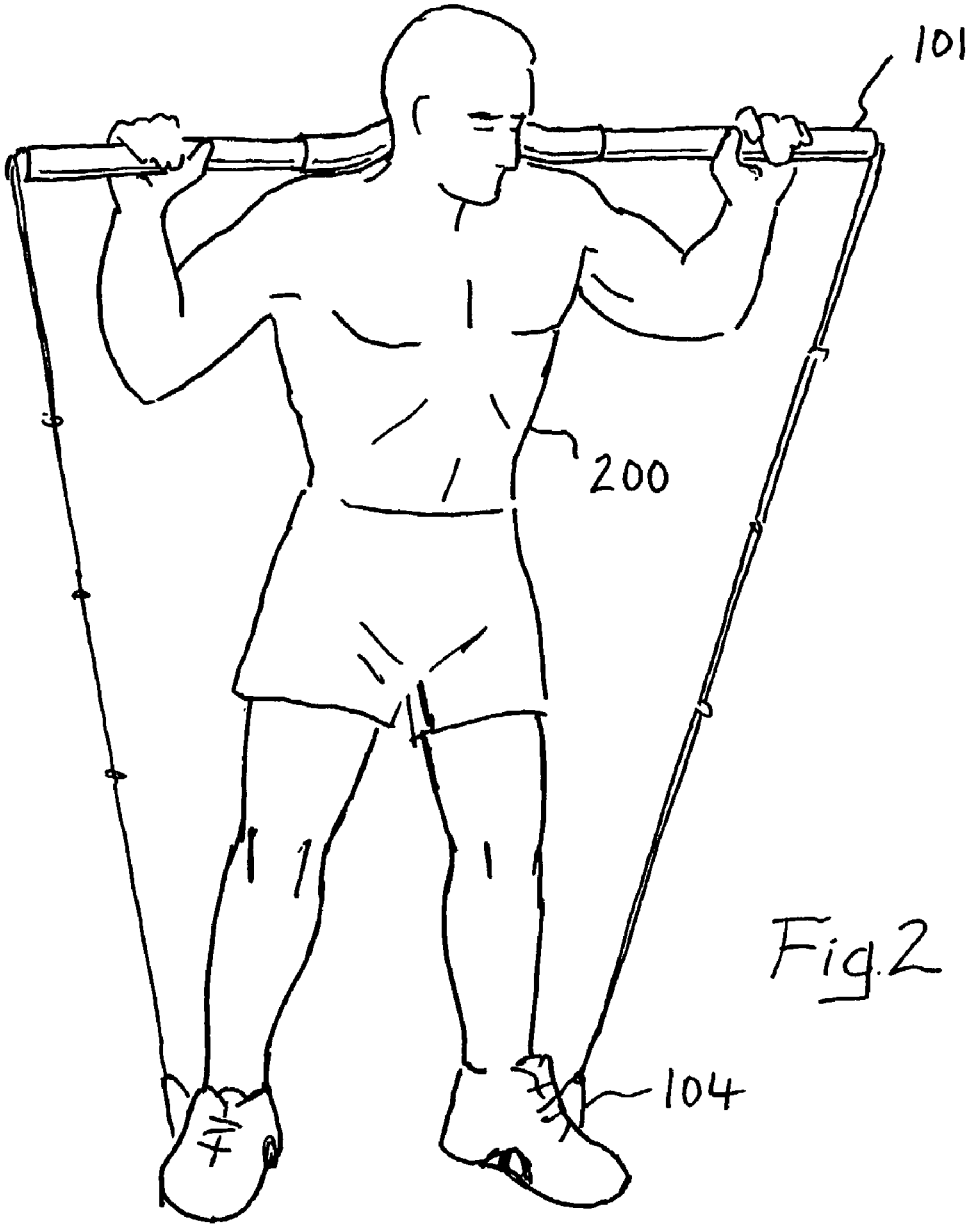
FIG. 2 is a pictorial depicting the use of an exercise device by a user in accordance with an exemplary embodiment of the present invention.
Figure 3:
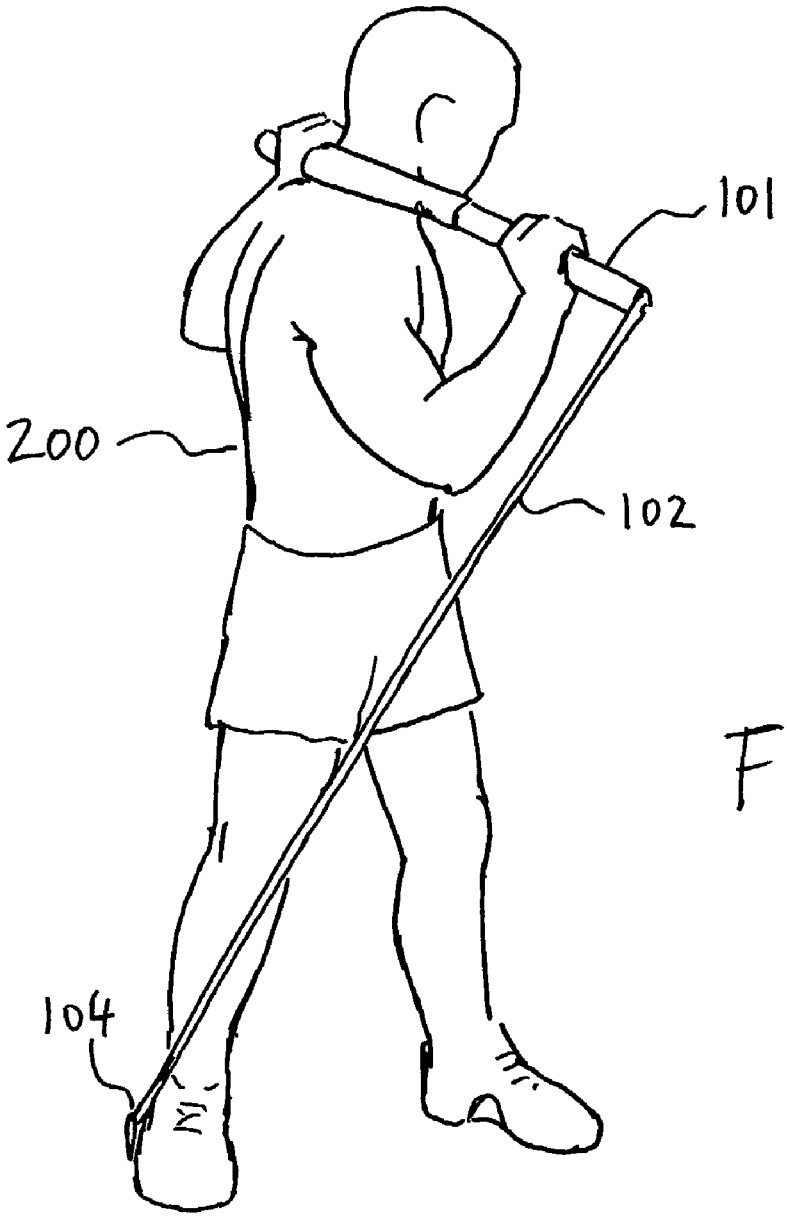
FIG. 3 is a pictorial depicting the rotational motion applied by a user in accordance with an exemplary embodiment of the present invention.

To afford a clear understanding of how exercise device 100 may operate, FIG. 2 and FIG. 3 depict a user 200 employing exercise device 100 in accordance with a preferred mode of use. FIG. 2 shows user 200 in a standing position having placed rod 101 upon the shoulders and behind the neck and then having secured each anchoring element 104 under foot. FIG. 2 depicts that user 200 has not yet rotated at the waist and is thus at a rest position for the present type of exercise. With user 200 in this position, each elastic member 102 may be taut or may be slightly loose depending on the desired adjustments of the elastic members. FIG. 3 shows user 200 having rotated the upper body relative to the stance. Note that rod 101 is now moved into a position that extends one or both of the elastic members 102 more so than in the rest position that was shown in FIG. 2. In FIG. 3, anchoring element 104 is still firmly held under the user's foot. Elastic members 102 are thus extended and offer resistance to the upper body rotation, exercising the oblique muscles responsible for the motion. User 200 exercises by swiveling in either direction, thrusting forward either end of rod 101 against the force applied by elastic members 102.

FIG. 2 and FIG. 3 generally depict a preferred mode of use. However, many variations in stance and posture are possible to suit the user and to achieve desired results. For example, maintaining a slightly crouched position may be preferred in some instances by some users. Furthermore, it should be understood that anchoring element 104 may be designed to allow attachment to fixed points other than by being held under the foot of the user. In use, anchoring element 104 may accomplish anchoring to a fixed object or may be affixed to or placed under the wheel of a wheelchair. Anchoring element 104 may be integral with elastic member 102. For example, anchoring element 104 may be simply formed as a loop at the end of elastic member 102.

Each elastic member 102 may be more generally characterized as an extensible resistance member referring to the properties that the member is able to be extended in length and provides resistance to forces applied to cause such extension. In one embodiment, elastic member 102 may comprise a metal spring or a length of rubber material similar to bungee cord. Alternatively, some portions of member 102 need not be elastic. For example, member 102 may comprise some sections along its length that are made of braided nylon or the like which contributes negligibly to the overall stretch of the member. Such an embodiment may be preferred, for example, where clamping and adjustment devices will work more reliably on low-stretch materials than on stretchy materials.

An extensible resistance member may be designed to offer resistance or counter-acting forces in response to any change in extension. An extensible resistance member may be designed to resist being extended or lengthened, to resist being compressed or shortened, or to resist both lengthening and shortening.

Member 102 need not be flexible along part or all of its length. For example, each member 102 may comprise a rod sliding within a sleeve, with the rod being coupled to a pneumatic or hydraulic piston inside the sleeve. Such resistance devices are well-known and commonly used in exercise equipment and in door closing devices. Member 102 may provide resistance to being extended without necessarily applying any force when the rod is not moving. For example, the aforementioned sliding rod arrangement may be adapted to force fluid, such as air or a viscous liquid, through an orifice causing a damping action that impedes motion without necessarily applying force when at rest. Member 102 may resist changes in extension by using friction. For example, it is contemplated that a changes in extension may cause two surfaces to rub against one another, impeding the change in extension.

Alternatively, member 102 may resist changes in extension by using a mechanical spring or some other deformable, resilient material. Member 102 may resist changes in extension by causing movement of a fluid, for example, by causing a fan blade to blow air or causing an object to move quickly enough through a fluid, such as air or a viscous fluid, to experience substantial resistance. Member 102 may resist changes in extension by coupling to an electrical brake wherein motion is converted into electrical current which is then applied to an electrically resistive load. Member 102 may resist changes in extension by having a magnet induce eddy currents in an electrically conductive material.

It will be appreciated that any ability of member 102 to offer resistance to changes in extension will cause abdominal muscles to do work in the course of using the invention as taught herein. Any of the foregoing techniques, or equivalent techniques, or combinations thereof may be readily employed by one of ordinary skill without undue experimentation.

Those of ordinary skill in the art will recognize that various of the above examples of rigid, flexible, and resilient elements may be to employed alone or in combination to form a composite extensible resistive member suitable to serve the function that elastic member 102 serves in the present exemplary embodiment.

Elastic member 102, or other elements serving in a similar capacity, are preferably provided with means for being adjusted by the user in terms of length, springiness, or both aspects. The length of elastic member 102 may be adjusted to suit the stature of the user or the posture assumed by the user during use of the exercise device. The resistance to motion offered by elastic member 102 is also preferably adjustable so that the user may adjust the intensity of the exercise. In an exemplary embodiment, elastic member 102 comprises an elastic strap or band which may be lengthened or shortened to vary both static length and stiffness in combination. Shortening the elastic element increases the amount of force needed to accomplish a given deflection of the rod relative to the user's stance. The elastic may be shortened such that a pre-load exists in the elastic members even when the user is at a rest position. It is contemplated that markings along an elastic element 102 may provide an index by which the user may reproduce desired settings or gage progress toward higher effort levels. Those of ordinary skill in the art will recognize that many arrangements for observing particular length and resistance settings and for fixing extensible members at a desired setting are possible within the spirit and scope of the present invention.

Figure 4:
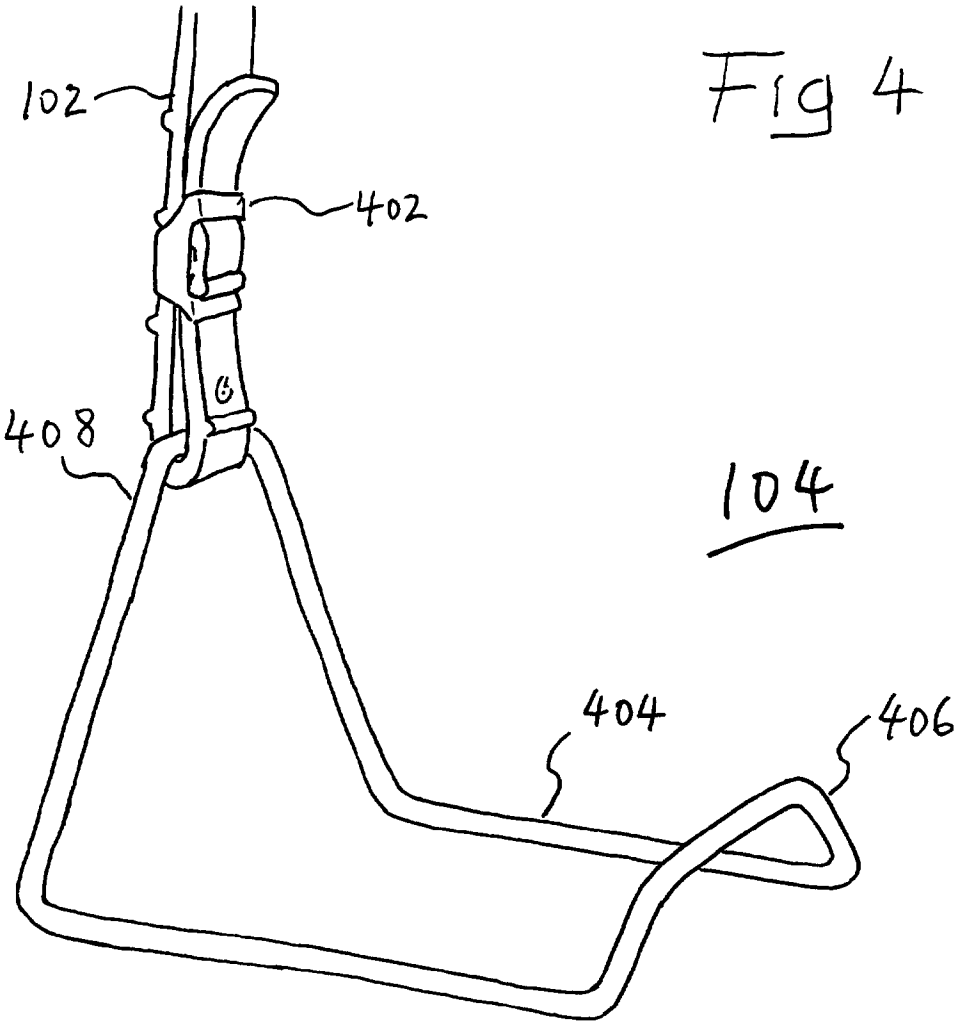
FIG. 4 is a diagram of a anchoring element for securing one end of an extensible resistance member under the foot of a user.

FIG. 4 shows an example design of an anchoring element 104 attached to an end of an elastic member 102. As shown, anchoring element 104 might be formed by bending of metal wire and comprises a step portion 404 that the user steps upon to accomplish anchoring to the floor. An inner raised portion 406 is formed to more securely hook the user's foot. An outer raised portion 408 provides a point of attachment whereby anchoring element 104 is coupled to elastic member 102. By suitably proportioning the height of outer raised portion 408 to the width of step portion 404, anchoring element 104 may be caused to hang from elastic member 102 in an orientation that facilitates capturing the anchoring element under the user's foot.

FIG. 4 depicts that elastic member 102 is simply coupled to anchoring element 104 by looping elastic member 102 through buckle 402 or the like. Buckle 402 may additionally serve as a point for adjusting the length or tension along elastic member 102.

Of course, many variations are possible in the design and operation of both the anchoring point 104 and the attachment by which anchoring point 104 is coupled to the end of elastic member 102. For example, anchoring point 104 may be molded from a rigid durable plastic or metal. Anchoring point 104 may engage elastic member 102 for some length to promote hanging in a position that facilitates the user capturing the anchoring point under foot. Anchoring point 104 may be formed with an integral structure, similar to a buckle, through which elastic member 102 is looped and held securely thereto. Those of ordinary skill may readily implement a variety of suitable designs subject to desired characteristics and manufacturing techniques and without undue experimentation.

Figure 5:
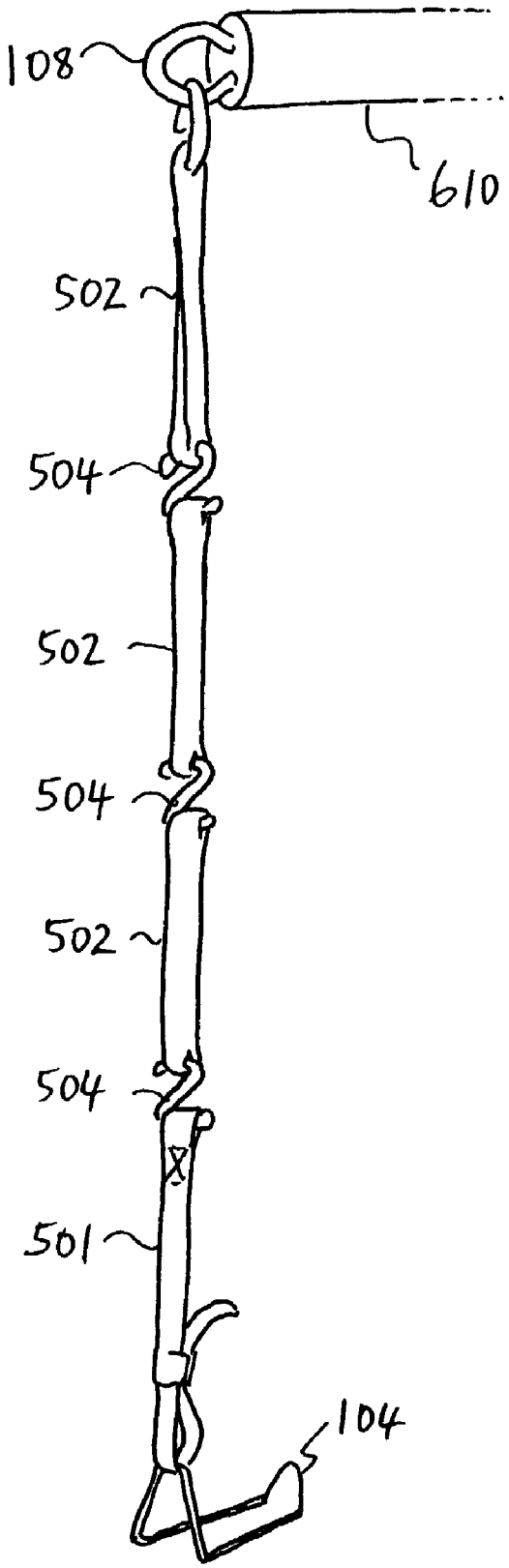
FIG. 5 is a diagram of an extensible resistance member comprising removable sections.

FIG. 5 of the drawings depicts an embodiment wherein elastic member 102 comprises one or more removable elastic segments 502 joined together by couplings 504. A fixed section 501 is included as part of elastic member 102 as a "stub" that interfaces the removable elastic segments to rod 101 via attachment at attachment point 108. Fixed section 501 is "fixed" in the sense that it may always be used with the device, even as other elements, such as segments 502, are included or excluded during use. Fixed section 501 may or may not be elastic or extensible. Fixed section 501 may be desirable to provide a large portion of the overall length of elastic member 102. Whereas each removable section 502 may be made of an elastomer or the like, fixed section 501 may add length to elastic member 102 while being made of a less expensive material, such as cotton or nylon braid. Fixed section 501 may comprise length adjusting means by which the user may finely adjust the overall length of elastic member 102.

An added advantage of the configuration of FIG. 5 is that removable sections 502 may be connected in series or parallel to allow further control over stiffness of the composite structure. Coupling 504 may be an "S"-shaped metal or plastic hook which engages holes or loops in removable section 502, fixed section 501, or attachment point 108. It will be apparent to those of skill in the art that various arrangements of fixed length and extensible members may be used in series or in parallel to achieve a desired stiffness and to accommodate an overall length that best suits the stature of the user. An extensible resistance member may comprise a composite of various extensible and fixed length elements.

Figure 6A:
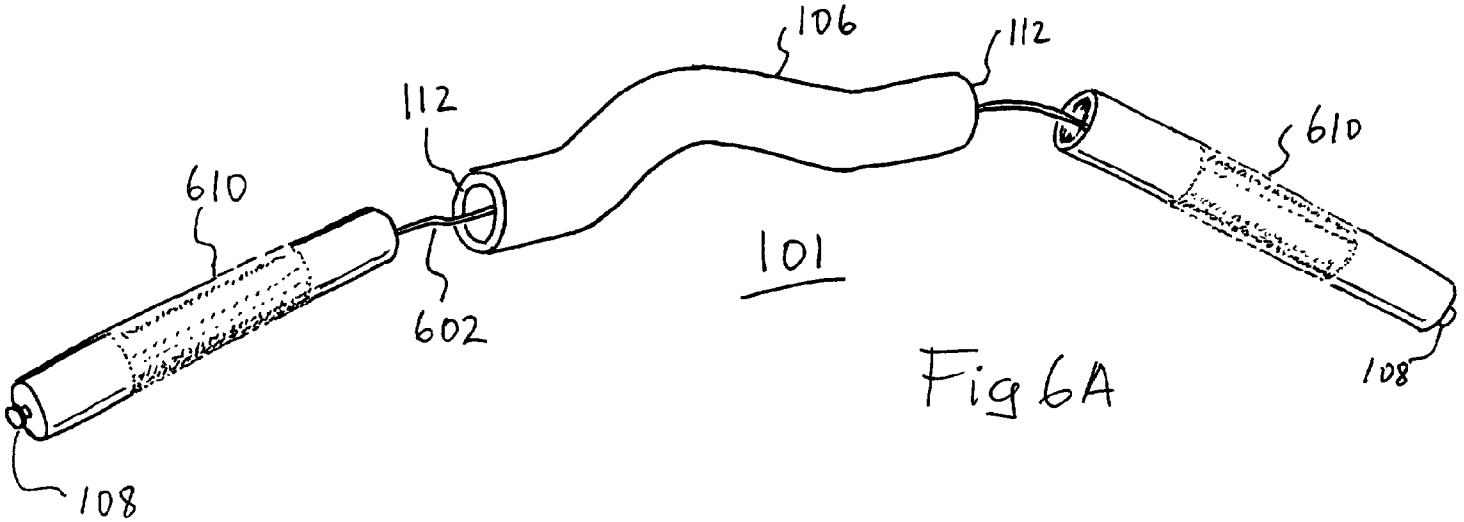
FIGS. 6A and 6B are pictorials showing the disassembly and folding of an exercise device in accordance with an exemplary embodiment of the present invention.
Figure 6B:
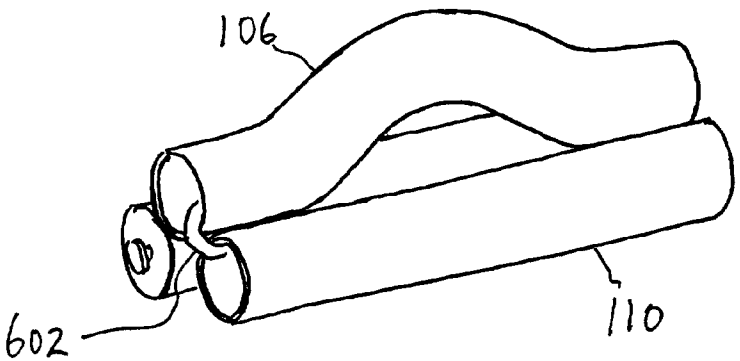

FIG. 6A and FIG. 6B depict an exemplary manner in which rod 101 may be disassembled into sections and folded into a compact form. FIG. 6A shows middle section 106 separated from both grip section 610, having been separated along detachment points 112. Preferably, the sections remain loosely attached by a plain or elastic cord 602. At each detachment point 112, a grip section 610 may fit into or wedge into a corresponding opening in middle section 106. Many variations are possible and well known by which a removable coupling may be accomplished at detachment point 112. For example, one end of grip section 610 may be tapered to nest securely into an end of middle section 106. Grip section 610 and middle section 106 may each be provided with transverse holes which may align to allow insertion of a holding pin. As an alternative to a separate holding pin, grip section 610 may comprise one or more captive, spring-loaded pins which snap into corresponding holes in middle section 106. Such a removable attachment is often used where tubular members are to nest into one another. (One such detachable fitting is depicted in FIG. 6 of U.S. Pat. No. 6,126,581 to Hartsel.) Yet another configuration may involve a "twist-lock" assembly of grip section 610 to middle section 106.

FIG. 6A happens to show attachment point 108 as being a stud or knob protruding from the end of grip section 610 as one exemplary approach. This is one variation by which a slot or hole in an elastic member may be coupled to the ends of rod 101. A similar design is often employed for attaching a shoulder strap to a guitar.

FIG. 6B depicts the disassembled elements of rod 101 having been folded into a compact arrangement, still loosely bound by cord 602 in accordance with an exemplary embodiment.

It is contemplated that a single element may be threaded through sections of rod 101, with the same element also serving as part or all of elastic member 102. In such a case, securing means may be desirable at attachment points 108 for locking the element in place with respect to rod 101.

The present invention, embodied for example as shown and described herein, is advantageous for its particular effectiveness in exercising oblique abdominal muscles while being compact and simple to manufacture. Furthermore, the present invention is safer than prior art approaches because the rotating mass, and therefore the inertia, is minimal and does not pose the risk of injury that would be present by setting a large mass in motion. It may be observed that a device in accordance with an exemplary embodiment of the present invention may exhibit negligible rotational inertia by virtue of the low mass of rod 101 and low "resistance inertia" by virtue of the resistance being caused by means other than lifting or moving of massive objects. As another advantage of the present invention, rotational inertia does not need to increase appreciably as higher resistance settings are selected by a user.

The present invention has thus far been shown, by way of example, to achieve coupling to a user's upper body by being gripped in both hands and being held in position substantially across the user's shoulders. Those of ordinary skill will appreciate that other methods of use may achieve the same aim of exercising the oblique abdominal muscles without involving both hands of the user. For example, a person having one arm incapacitated or missing may still employ a device or method according to the present invention by using one hand on one side and causing rod 101 to bear upon the shoulder of the opposite side. Alternatively, one of ordinary skill may envision an additional attachment coupled to rod 101 to better accommodate coupling to a user's shoulder or upper body. It is even contemplated that shoulder rests might be properly designed to allow rod 101 to be coupled to the upper body of the user perhaps without either or both hands being engaged in holding the rod.

An alternative method of use by some individuals might involve positioning rod 101 in front of the user, such as across the chest, and provide for coupling to the shoulders, under the arms, or behind the neck by using the hands or by using other means such as straps. Users with physical disabilities may find some of these alternatives useful. The embodiment involving both hands holding rod 101 behind the neck is believed to be advantageous for aligning downward forces from elastic members directly with the user's spine, preventing stress on the back muscles. This embodiment is also believed to be advantageous for keeping the user's arms raised and encouraging proper tensioning of the abdominal muscles.

One of ordinary skill in the art will appreciate that it is possible to select sufficiently strong yet lightweight materials in the construction of rod 101, extensible resistance member, such as elastic member 102, and anchoring elements 104 so that the overall mass of a device embodying the present invention may be under 5 kilograms.

While the present invention has been shown and described in the context of an exemplary embodiment, such description is provided merely by way of instruction and should not be construed to limit the invention. Those of ordinary skill in the relevant art will recognize that variations are possible in design and operation without departing from the spirit and scope of the invention which is defined by interpretation of the appended claims.

What is claimed is:

1. A device to aid a user in exercising abdominal muscles comprising:

An elongated rigid member being mechanically coupled to the user's upper body whereby rotational movement of the upper body imparts rotational movement to the rigid member, wherein the rigid member comprises an arcuate portion designed and configured to accommodate a back portion of the user's neck to facilitate stable positioning of contact between the user's neck and the rigid member, and at least one extensible resistance member having a first end and second end, wherein the first end is attached to the rigid member and the second end is attachable to at least one location isolated from the movement of the user's upper body, wherein rotational movement of the elongated rigid member causes chance in extension of the extensible resistance member and the extensible resistance member exerts a force on the rigid member opposing the change in extension, wherein the extensible resistance member is adjustable to vary at least one of the length of the extensible member and the degree of resistance to changes in extension exhibited by the extensible member, and wherein the moment of inertia exerted by the rigid member on the upper body of the user remains substantially constant as the resistance to changes in extension of the extensible resistance member is varied.

2. The device of claim 1 wherein the location isolated from the movement of the user's upper body is designed and configured to maintain a substantially fixed location with respect to the user's lower body.

3. The device of claim 1 wherein the rigid member is designed and configured to be mechanically coupled to the user's upper body by contact of the rigid member with at least one of: the user's hand, the user's neck, and the user's shoulder.

4. The device of claim 1 wherein the rigid member comprises two or more separable sections that may be assembled to form the elongated rigid member.

5. The device of claim 1 wherein the mass of the device is less than 5 kilograms.

6. The device of claim 1 wherein the extensible resistance member is removable from the elongated rigid member.

7. The device of claim 1 wherein the extensible resistance member comprises an elastic material.

8. The device of claim 1 wherein the rigid member is elongated and is designed and configured and of sufficient dimension to extend laterally across the shoulders of the user and to protrude sufficiently beyond each shoulder such that at least one of the user's hands may hold the rigid member in place across the shoulders behind the user's neck.

9. The device of claim 1 further comprising at least one anchoring element attached to the second end of the extensible resistance member wherein the user may temporarily anchor the extensible resistance member to a location isolated from the movement of the user's upper body.

10. The device of claim 9 wherein the anchoring element is designed and configured to be held in place by the weight of the user.

11. The device of claim 9 wherein the anchoring element is designed and configured to be anchored by a portion of the user's lower body.

12. The device of claim 11 wherein the anchoring element is designed to engage at least one of the user's feet.

13. The device of claim 1 wherein the extensible resistance member comprises at least one non-elastic element having adjustable length and at least one elastic element.

14. A method for exercising abdominal muscles of a person comprising the steps of:

coupling an elongated rigid member to the upper body of the person wherein rotation of the upper body of the person relative to the lower body of the person causes rotation of the rigid member relative to the lower body of the person, and wherein the rigid member comprises an arcuate portion and wherein the coupling step further comprises placing the arcuate portion of the rigid member in contact with the back of the neck of a user, coupling a first end of at least one extensible resistance member to the rigid member, coupling a second end of the extensible resistance member to a location that is designed and configured to remain substantially fixed relative to the lower body of the person wherein rotational movement of the elongated rigid member causes change in extension of the extensible resistance member and the extensible resistance member exerts a force on the rigid member opposing the change in extension, and using the abdominal muscles of the person to force the rigid member to rotate relative to the lower body of the person and to cause the extensible resistance member to change in extension, wherein the extensible resistance member is adjustable to vary at least one of the length of the extensible member and the degree of resistance to changes in extension exhibited by the extensible member, and wherein the moment of inertia exerted by the rigid member on the upper body of the user remains substantially constant as the resistance to changes in extension of the extensible resistance member is varied.

* * * * *